US008763537B2

(12) United States Patent
Ng

(10) Patent No.: US 8,763,537 B2
(45) Date of Patent: Jul. 1, 2014

(54) VERTICALLY ELEVATED FOLDABLE FRAME

(76) Inventor: Kin Chung Ng, Hong Kong (CN)

( * ) Notice: Subject to any disclaimer, the term of this patent is extended or adjusted under 35 U.S.C. 154(b) by 0 days.

(21) Appl. No.: 13/700,206

(22) PCT Filed: Aug. 15, 2011

(86) PCT No.: PCT/CN2011/078401

§ 371 (c)(1),
(2), (4) Date: Nov. 27, 2012

(87) PCT Pub. No.: WO2012/092773

PCT Pub. Date: Jul. 12, 2012

(65) Prior Publication Data

US 2013/0319297 A1 Dec. 5, 2013

(30) Foreign Application Priority Data

Jan. 7, 2011 (CN) ..... 2011 2 0004664 U

(51) Int. Cl.
*A47B 3/00* (2006.01)

(52) U.S. Cl.
USPC ..... 108/35; 108/40; 297/331

(58) Field of Classification Search
USPC ..... 312/313–316, 317.3, 241, 280–282; 108/15, 18, 33–36, 40, 41, 169, 173, 108/174, 176, 178, 179, 128, 116, 117, 48, 108/76–80, 42, 152; 248/150, 240, 166, 248/434; 211/90.01, 90.02, 96, 150; 297/61, 331
See application file for complete search history.

(56) References Cited

U.S. PATENT DOCUMENTS

| | | | | | |
|---|---|---|---|---|---|
| 430,952 | A | * | 6/1890 | Hill | 297/331 |
| 1,116,091 | A | * | 11/1914 | McDonald | 248/244 |
| 1,579,784 | A | * | 4/1926 | Liptay et al. | 312/282 |
| 1,583,280 | A | * | 5/1926 | Cummings | 108/33 |
| 1,714,932 | A | * | 5/1929 | Sundin | 108/116 |
| 1,853,507 | A | * | 4/1932 | Chandler | 312/312 |
| 1,856,759 | A | * | 5/1932 | Grondin | 297/45 |
| 2,158,950 | A | * | 5/1939 | Swett | 108/35 |
| 2,353,331 | A | * | 7/1944 | Hall | 248/240.1 |
| 2,393,598 | A | * | 1/1946 | Doty et al. | 108/96 |
| 2,666,679 | A | * | 1/1954 | Olofsson | 108/10 |
| 2,902,085 | A | * | 9/1959 | Bahnson, Sr. | 297/115 |

(Continued)

FOREIGN PATENT DOCUMENTS

| | | | |
|---|---|---|---|
| CN | 2349885 | Y | 11/1999 |
| CN | 1640343 | A | 7/2005 |

(Continued)

*Primary Examiner* — Janet M Wilkens
(74) *Attorney, Agent, or Firm* — Locke Lord LLP

(57) ABSTRACT

A vertically foldable frame is disclosed. The frame comprises: a base; a first fixing post; a second fixing post; a sliding frame; at least one table surface; wherein the first fixing post and the second fixing post are respectively fixed on both ends of the base; a first guide rail and a second guide rail are provided on the first fixing post and the second fixing post respectively and opposite to each other, the sliding frame is provided between the first guide rail and the second guide rail and adapted to slide up and down along the first guide rail and the second guide rail; the table surface is horizontally connected to a side of the sliding frame and adapted to be rotated in a vertical plane around a joint between the table surface and the sliding frame, the table surface is adapted to be horizontally positioned.

11 Claims, 12 Drawing Sheets

(56) References Cited

U.S. PATENT DOCUMENTS

| | | | | | |
|---|---|---|---|---|---|
| 3,029,114 | A | * | 4/1962 | Oscoz Sanchez | 108/79 |
| 4,489,661 | A | * | 12/1984 | Fitzgerald | 108/169 |
| 4,829,910 | A | * | 5/1989 | Lirette | 108/80 |
| 5,131,547 | A | | 7/1992 | Goldberg | |
| 5,669,314 | A | * | 9/1997 | Grant | 108/48 |
| 6,123,207 | A | | 9/2000 | Mast | |
| 6,192,808 | B1 | | 2/2001 | Bue | |
| 2010/0116176 | A1 | | 5/2010 | Witkowski | |
| 2011/0017103 | A1 | * | 1/2011 | Lee | 108/42 |

FOREIGN PATENT DOCUMENTS

| | | | | |
|---|---|---|---|---|
| CN | 200947911 | Y | | 9/2007 |
| CN | 201146997 | Y | | 11/2008 |
| JP | 2000060674 | | * | 8/1998 |

* cited by examiner

VERTICALLY ELEVATED FOLDABLE FRAME

FIELD OF THE INVENTION

The present invention relates to the field of foldable furniture, and in particular to a vertically foldable frame.

BACKGROUND OF THE INVENTION

Furniture is an important appliance for daily life, and is usually composed of a table surface on four posts. With the increasingly rapid pace of life and the limitation of living space, the traditional furniture is inconvenient for use and occupies too much space.

In recent years, foldable furniture has become increasingly popular. The foldable furniture (or foldable frame) is a furniture which can be folded while in transportation or when not in use. For example, foldable furniture can be applied in modular kitchen designs, service carts, work benches, craft tables, gardening carts, and storage shelves.

Though the foldable frame can be folded to a certain size, the traditional foldable frame is still relatively large and heavy after being folded.

Furthermore, in order to reduce the cost of transportation, manufacturers will ship furniture in knock-down form ready to be assembled (RTA). As a result, customers will have to assemble the furniture after receiving the components, which leads to much inconvenience.

Accordingly, it is highly desirable to have a foldable frame which is preassembled, compact for transportation and storage, and can be unfolded to become a table or cart in their maximum size configuration. Furthermore, it is also desirable to be able to transform the folding frame from folded to open form very easily.

In U.S. Pat. No. 6,123,207, Mast discloses a shipping rack easily convertible to an extended mode for storing and shipping product, a display mode for displaying product, and a collapsed mode for storing the rack itself. The rack includes a pair of central support columns and a pair of outer posts on either side of the columns. A plurality of shelves is pivotally mounted between the posts and columns. In the extended mode, the shelves are horizontal. As the columns are raised with respect to the posts, the shelves pivot to the desired inclination. Once the shelves are essentially vertical and the posts are draw close to central columns, the rack is in the collapsed mode. The rack can be secured in any mode by a strut. A spring counterbalance system installed within one of the central columns assists the mode converse on of the rack.

This rack uses two central supporting posts and four side supporting posts to form the supporting structure, and is folded and unfolded through the spring counterbalance system. This structure is complicated.

In U.S. Pat. No. 5,131,547, Goldberg discloses a collapsible storage rack assembly including a plurality of upstanding, generally inverted U-shaped frame members between which extend a plurality of vertically spaced, collapsible shelf assemblies. Using crossbeams for frame support and foldable movement, the storage rack can be easily and quickly opened for use by moving the frame the frame members away from each other. In a similar manner, the storage rack can be easily collapse position, with the shelf assemblies collapsing by upward hinging movement. In the close and collapsed position, the shelf assemblies are substantially completely nested within the frame members, thereby facilitating convenient handling, shipment, and storage of the construction.

In U.S. Pat. No. 5,131,547, intersecting cross-braces are used to realize the folding of the frame. However, owing to intersecting cross-braces, the structure of the frame is also complicated.

SUMMARY OF THE INVENTION

It is a first object of the present invention to provide a foldable frame, which can be slid up and down and folded to a small size.

To achieve the above object, the present invention provides a foldable frame which comprises: a base; a first fixing post; a second fixing post; a sliding frame; a table surface; wherein the first fixing post and the second fixing post are respectively fixed on both ends of the base; a first guide rail and a second guide rail are provided on the first fixing post and the second fixing post respectively and opposite to each other, the sliding frame is provided between the first guide rail and the second guide rail and adapted to slide up and down along the first guide rail and the second guide rail; the table surface is horizontally connected to a side of the sliding frame and adapted to be rotated in a vertical plane around a joint between the table surface and the sliding frame, the table surface is adapted to be horizontally positioned; inclined levers are hinged to the table surface at one end, and the other end of the inclined levers is hinged to the base.

Preferably, an active post is further hinged to the back surface of the table surface, the active post is further hinged to a transverse lever at one end, and the other end of the transverse lever is hinged to the sliding frame; the table surface is horizontal when the bottom of the active post and the bottom of the base are horizontal.

Preferably, the transverse lever is connected to the active lever by a first joint, and the transverse lever is connected to the active lever by a second joint, wherein the first joint is lower than the second joint in horizontal level when the bottom of the active post is at the same horizontal level as the bottom of the base.

Preferably, the back surface of the table surface is further connected with two active posts, and each active post is hinged to the transverse lever.

Preferably, the back surface of the table surface is further hinged with two active posts, each active post is hinged to one end of the transverse lever, the other end of the transverse lever is hinged to the sliding frame; the table surface is horizontal when the bottom of each active post is at the same horizontal level as the bottom of the base; an inclined lever is hinged to the back surface of the table surface and located between the two active posts, and the other end of the inclined lever is hinged to the base.

Preferably, the back surface of the table surface is further hinged with an active post, a vertical gap is provided in the active post while a transverse lever is hinged to the vertical gap, the other end of the transverse lever is hinged to the sliding frame; the table surface is horizontal when the bottom of the active post is at the same horizontal level as the bottom of the base; two inclined levers are hinged to the back surface of the table surface and located at both sides of the active post, and the other end of the inclined levers is hinged to the base.

Preferably, the first fixing post, the second fixing post, and the first guide rail and the second guide rail in the first fixing post and the second fixing post are all higher than the table surface when the table surface is rotated to be horizontal.

Preferably, the first guide rail and the second guide rail are straight, arched or zigzag in shape.

Preferably, the sliding frame is a sliding table surface, or a frame formed by a plurality of boards.

The present invention also provides a foldable frame, which comprises: a base; a first fixing post; a second fixing post; a sliding frame; two table surfaces; the two table surfaces are horizontally connected to a side of the sliding frame and adapted to be respectively rotated in a vertical plane around a joint between each table surface and the sliding frame, the table surface is adapted to be horizontally positioned; the first fixing post and the second fixing post are respectively fixed on both ends of the base;

a first guide rail and a second guide rail are provided on the first fixing post and the second fixing post respectively and opposite to each other, the sliding frame is provided between the first guide rail and the second guide rail and adapted to slide up and down along the first guide rail and the second guide rail; an active post is further hinged to the back surface of the table surface, the active post is further hinged to a transverse lever at one end, and the other end of the transverse lever is hinged to the sliding frame; the table surface is horizontal when the bottom of the active post and the bottom of the base are horizontal; an inclined lever is hinged to the back surface of the table surface, and the other end of the inclined lever is hinged to the base.

It can be seen from the above that owing to the sliding frame in the foldable frame, when the foldable frame is folded, the sliding frame can be raised such that the entire height of the foldable frame is increased, and thus it is especially suitable for the foldable furniture with a long table surface. Comparing with the traditional furniture in which only the table surface is rotatable, the structure in this embodiment is more suitable for various situations. Therefore, it solves the conflict between the length of the table surface and the use height of the foldable frame, whereby in the furniture with a relatively low height, the table surface can be relatively long, and after folding, the volume is small, which reduces the transportation cost and is convenient for use.

BRIEF DESCRIPTION OF THE DRAWINGS

For a better understanding of this invention it will now be described with respect to an exemplary embodiment which shall be described herein with the assistance of drawings wherein.

BRIEF DESCRIPTION OF THE PREFERRED EMBODIMENTS

Embodiment 1

Figure 1:
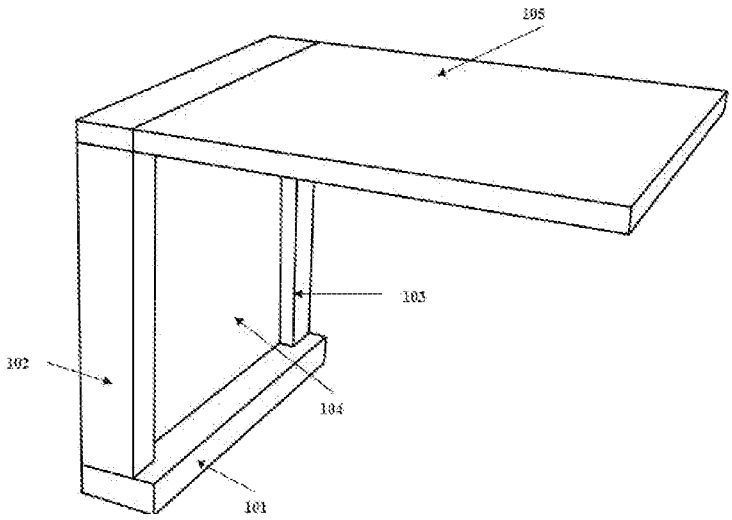
FIG. 1 is a schematic structural view showing a single-wing foldable table that can be slid up and down according to the first embodiment 1, in fully unfolded state.
Figure 2:
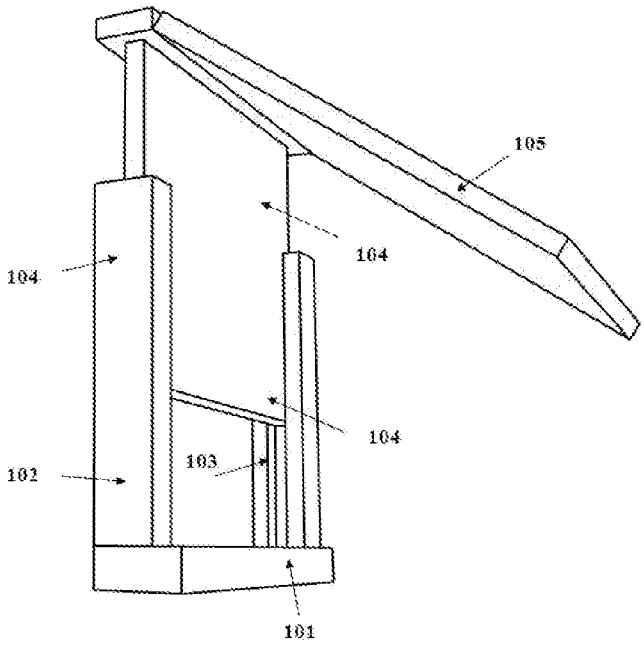
FIG. 2 is a schematic structural view showing the single-wing foldable table of FIG. 1 in half folded state.
Figure 3:
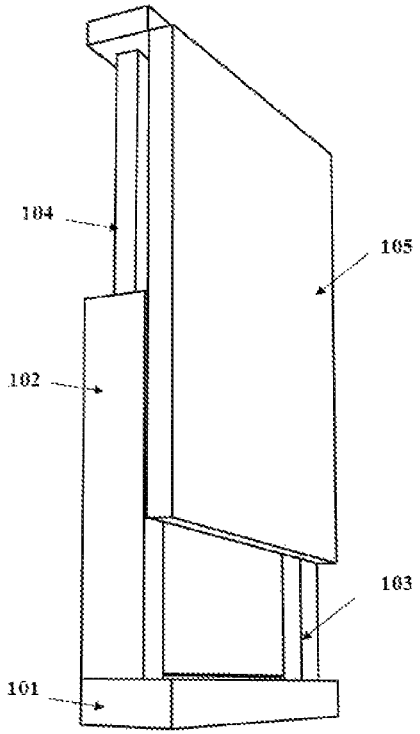
FIG. 3 is a schematic structural view showing the single-wing foldable table of FIG. 1 in fully unfolded state.

FIG. 1 is a schematic structural view showing a single-wing foldable table that can be slid up and down, in fully unfolded state; FIG. 2 is a schematic structural view showing the single-wing foldable table of FIG. 1 in half folded state; FIG. 3 is a schematic structural view showing the single-wing foldable table of FIG. 1 in fully unfolded state.

As shown in FIGS. 1, 2 and 3, the foldable frame mainly include a base 101, a first fixing post 102, a second fixing post 103, a sliding frame 104, and at least one table surface 105.

The first fixing post 102 and the second fixing post 103 are respectively fixed at both ends of the base 101. A first guide rail (not shown, but can be various types of rails that allow object to be sliding thereon) and a second guide rail (not shown, but can be various types of rails that allow object to be sliding thereon) are respectively on the inner side of the first fixing post 102 and the inner side of the second fixing post 103. The first guide rail is opposite to the second guide rail. The sliding frame 104 is arranged between the first guide rail and the second guide rail to enable the sliding frame 104 to slide up and down along the first guide rail and the second guide rail on the first fixing post 102 and the second fixing post 103. The table surface 105 is connected to the side of the sliding frame 104 through at least two joints such that the table surface 105 can be rotated around a line formed by the joints between the table surface 105 and the sliding frame 104 and in the vertical plane. When the table surface 105 is rotated to be horizontal, the table surface 105 can be fixed in horizontal position and thus in use state, by several pins or other securing means.

When in use, the securing means for horizontal positioning of the table surface 105 can be released, the sliding frame 104 is raised, and the table surface 105 on the side of the sliding frame 104 is rotated downwards until it is vertically attached to the folding structure of the sliding frame 104. A positioning locking means can also be provided between the table surface 105 and the sliding frame 104, the second fixing post 103 or the second fixing post 102, and in this way, when the foldable frame is folded, the positioning locking means is locked such that the table surface 105 is fixed on the side of the second fixing post 102 and the second fixing post 103.

When it is desired to unfold the frame, the table surface 105 can be rotated to be horizontal and fixed at horizontal level, while the sliding frame 104 is lowered down. In this way, the foldable frame is fully unfolded and thus in use state.

It can be seen from the above, owing to the sliding frame in the foldable frame, the sliding frame 104 can be raised when folding the foldable frame such that the entire height of the foldable frame is increased, and thus it is especially suitable for the foldable furniture with a long table surface 105. Comparing with the traditional furniture in which only the table surface 105 is rotatable, the structure in this embodiment is more suitable for various situations. Therefore, it solves the conflict between the length of the table surface and the use height of the foldable frame, whereby in the furniture with a relatively low height, the table surface can be relatively long, and after folding, the volume is small, which reduces the transportation cost and is convenient for use.

In this embodiment, the table surface 105 may also be connected to the sliding frame 104 via means other than hinges. In addition, the table surface 105 may also be integrated with the sliding frame 104 as long as the table surface 105 can be rotated around the folding line between the sliding frame 104 and the table surface 105. A rotatable plastic element may be used.

From the technical solution of this embodiment, it can be designed that as shown in FIGS. 1, 2 and 3, only one table surface 105 is provided at one side of the sliding frame 104 to form a single-wing structure. Alternatively, one table surface 105 may be provided at each side of the sliding frame 104 to form a double-wing structure. However, two or three table surfaces 105 may be provided at each side of the sliding frame 104 if desired.

Embodiment 2

Figure 4:
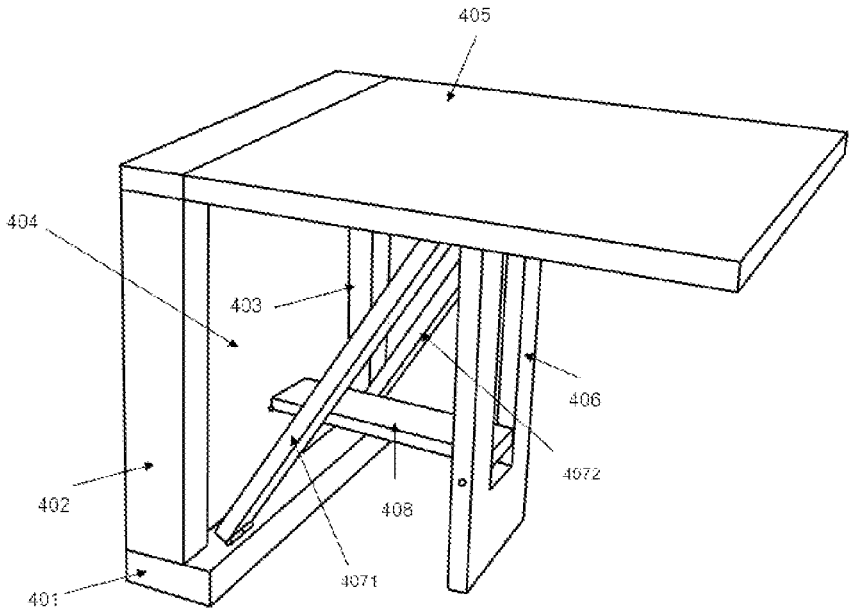
FIG. 4 is a schematic structural view showing a further single-wing foldable table that can be slid up and down according to the second embodiment 2, in fully unfolded state.
Figure 5:
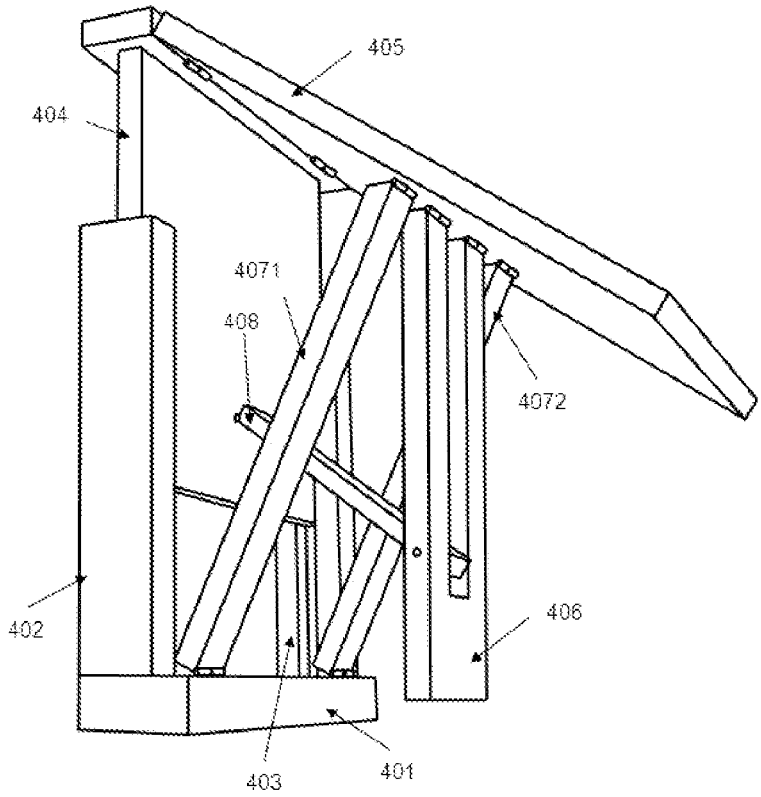
FIG. 5 is a schematic structural view showing the single-wing foldable table of FIG. 4 in half folded state.
Figure 6:
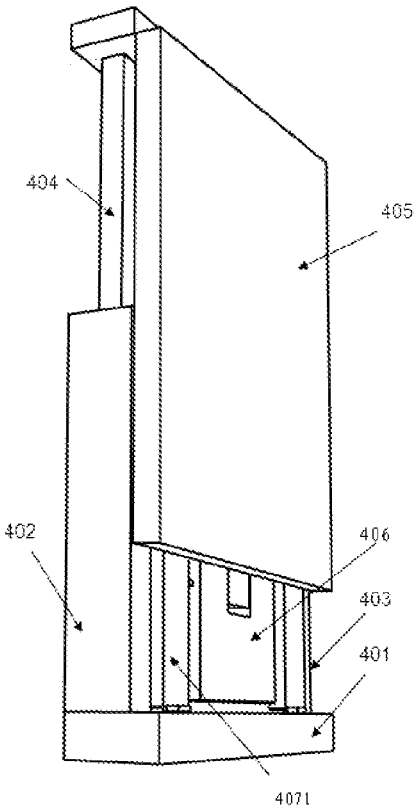
FIG. 6 is a schematic structural view showing the single-wing foldable table of FIG. 4 in fully folded state.

FIG. 4 is a schematic structural view showing a further single-wing foldable table that can be slid up and down, in fully unfolded state; FIG. 5 is a schematic structural view showing the single-wing foldable table of FIG. 4 in half folded state; FIG. 6 is a schematic structural view showing the single-wing foldable table of FIG. 4 in fully folded state.

Referring to FIGS. 4, 5 and 6, the foldable frame mainly include a base 401, a first fixing post 402 and a second fixing post 403 respectively fixed on both sides of the base 401. A first guide rail and a second guide rail are respectively on the inner side of the first fixing post 402 and the inner side of the second fixing post 403. The sliding frame 404 (the sliding frame 404 is not limited to a sliding plate of this embodiment) is arranged between the first guide rail and the second guide rail to enable the sliding frame 404 to slide up and down along the first guide rail and the second guide rail on the first fixing post 402 and the second fixing post 403. A table surface 405 is mounted on one side of the top of the sliding frame 404 such that the table surface 405 can be rotated along the joint between the table surface 405 and the sliding frame 404 in the vertical plane. The back surface of the table surface 405 is further connected with one active post 406 which is opposite to the first fixing post 402 and the second fixing post 403, and the active post 406 can be rotated around the joint between the active post 406 and the table surface 405. When the table surface 405 is rotated to be horizontal, the active post 406 can touch the ground, and the first fixing post 402 and the second fixing post 403 support the horizontal table surface 405 together.

As shown in FIGS. 5 and 6, when the table is not in use, the sliding frame 404 is raised to enable the active post 406 to leave the ground, and the table surface 405 above the frame is rotated downwards due to the loss of support from the active post 406. When the sliding frame 404 is raised to a certain height level, the table surface 405 is rotated to be vertical and hung on the side of the sliding frame 404, and as shown in FIG. 6, at this time, the foldable table is folded to occupy the minimum space, which is convenient for transporting and saving the cost of transportation.

In order to further improve the stability of the foldable table, inclined levers 4071 and 4072 are connected between the back surface of the table surface 405 and the base 401. The inclined levers 4071 and 4072 can be respectively rotated around their own joints between the base 401 and the inclined levers 4071 and 4072. Therefore, when in use, the inclined supporting beam, the table surface 405, and the sliding frame form a right-angled triangle substantially, and the supporting beam, the active post 406 and the floor form a right-angled triangle substantially such that the foldable table has a stable supporting structure and is not easy to be deformed when it is in fully unfolded state as shown in FIG. 4.

In addition, in order to further improve the stability of the supporting structure of the table in this embodiment, a transverse lever 408 may be connected between the active post 406 and the sliding frame 104. The transverse lever 408 can be rotated around the joint between the transverse lever 408 and the active post 406, and around the joint between the transverse lever 408 and the sliding frame 104. When the foldable table is fully unfolded as shown in FIG. 4, a triangle is formed by the transverse lever 408, the active post 406 and the inclined lever 4071 or 4072, it further secures the active post 406 and improves the stability of the foldable table in unfolded state.

In this embodiment, in order to facilitate the folding operation of the foldable frame, it is constructed such that the transverse lever 408 is connected to the active lever 406 by a first joint, and the transverse lever 408 is connected to the active lever 406 by a second joint, wherein the first joint is lower than the second joint in horizontal level when the bottom of the active post 406 is at the same horizontal level as the bottom of the base 401.

In this way, when folding the foldable frame, the operator only has to raise the table surface slightly, since the second joint is higher than the first joint in horizontal level, the transverse lever 408 gives an upward force to the sliding frame 404 due to inertia, the active post 406 is moved together with the transverse lever 408 on the other end. In this way, the force required for folding is reduced, and the operation is easier.

As shown in FIGS. 4, 5 and 6, to facilitate the mounting of the transverse lever 408, the active post 406 is provided with a gap to which the transverse lever 408 is connected. In this way, the smooth movement of the transverse lever 40 is ensured.

In addition, the joints around which parts can be rotated may be realized by hinges or other possible manners in the art.

During the folding of the table as shown in FIGS. 5 and 6, the inclined levers 4071, 4072 are rotated inwards along with the table surface 405. When the sliding frame 404 is raised to the uppermost position and the table surface 405 is hung on the side of the sliding frame 404, the inclined levers 4071, 4072 are rotated to upstanding state, the volume is minimized after folding.

During the folding of the table, one end of the transverse lever 408 is raised along with the sliding table surface 405, and the table surface 405 is thus rotated under the driving of said one end, whereby the whole folding operation is smoother. Similarly, during the unfolding of the table, the transverse lever 408 links the movements of the sliding frame 404 and the table surface 405, which facilitates the unfolding of the table.

Embodiment 3

Figure 7:
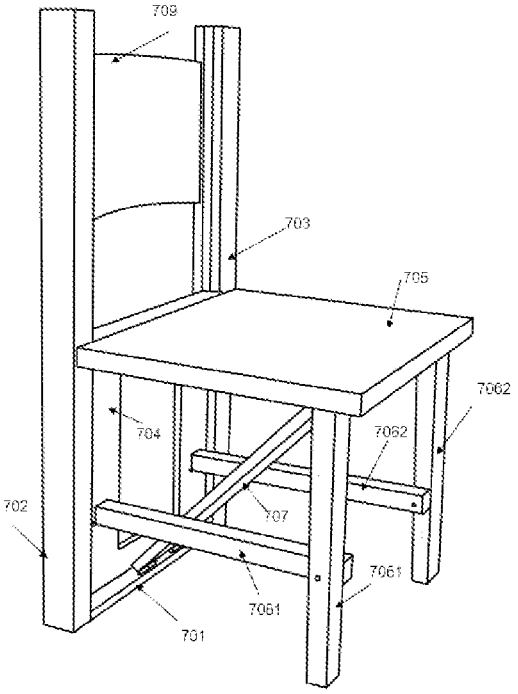
FIG. 7 is a schematic perspective view showing a first kind of foldable chair with sliding foldable frame according to the embodiment 3, in fully unfolded state.
Figure 8:
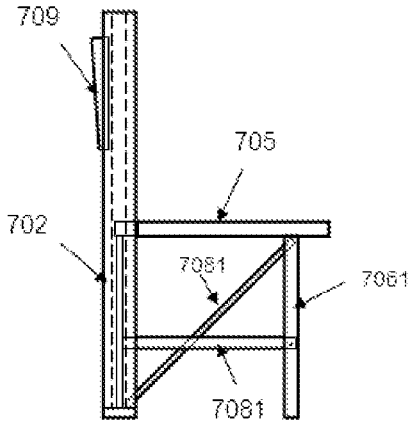
FIG. 8 is a schematic side view showing the foldable chair of FIG. 7 in fully unfolded state.
Figure 9:
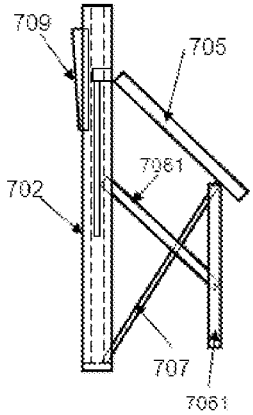
FIG. 9 is a schematic side view showing the foldable chair of FIG. 7 in half folded state.
Figure 10:
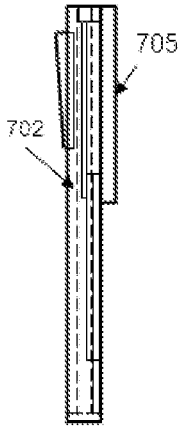
FIG. 10 is a schematic side view showing the foldable chair of FIG. 7 in fully folded state.

FIG. 7 is a schematic perspective view showing a first kind of foldable chair with sliding foldable frame, in fully unfolded state; FIG. 8 is a schematic side view showing the foldable chair of FIG. 7 in fully unfolded state; FIG. 9 is a schematic side view showing the foldable chair of FIG. 7 in half folded state; FIG. 10 is a schematic side view showing the foldable chair of FIG. 7 in fully folded state.

As shown in FIGS. 7, 8, 9 and 10, the foldable chair includes a base 701, a first fixing post 702 and a second fixing post 703 respectively fixed on both sides of the base 701. A transverse beam 709 is further provided on the back portions of the first fixing post 701 and the second fixing post 702. The transverse beam 709, the first fixing post 701 and the second fixing post 702 are used as back rest when in use. A first guide rail mechanism and a second guide rail mechanism are respectively on the inner side of the first fixing post 702 and the inner side of the second fixing post 703. The sliding frame 704 (the sliding frame 704 is not limited to a frame consisting of several bars) is arranged between the first guide rail mechanism and the second guide rail mechanism to enable the sliding frame 704 to slide up and down along the first guide rail mechanism and the second guide rail mechanism on the first fixing post 702 and the second fixing post 703. A table surface 750 is mounted on one side of the sliding frame 704 and can be used as the seat when the chair is in fully unfolded state. The table surface 705 can be rotated around the joint between the table surface 705 and the sliding frame 704 in the vertical plane.

The back surface of the table surface 705 is further connected with two active posts 7061, 7062 which are opposite to the first fixing post 702 and the second fixing post 703, and each of the active posts can be rotated around the joint between each active post and the table surface 705. When the table surface 705 is rotated to be horizontal, the active posts 7061 and 7062 can touch the ground, and the first fixing post 702 and the second fixing post 703 support the horizontal table surface 705 together so as to form a chair.

As shown in FIGS. 9 and 10, when the chair is not in use, the sliding frame 704 is raised to enable the active posts 7061 and 7062 to leave the ground, and the table surface 705 above the sliding frame 704 is rotated downwards due to the loss of support from the active posts 7061 and 7062. When the sliding frame 704 is raised to a certain height level, the table surface 705 is rotated to be vertical and hung on the side of the sliding frame 704, and as shown in FIG. 10, at this time, the foldable chair is folded to occupy the minimum space, which is convenient for transporting and saving the cost of transportation.

In order to further improve the stability of the foldable chair, an inclined lever 707 is connected between the back surface of the table surface 705 and the base 701. The inclined lever 707 can be rotated around the joint between the base 701 and the inclined lever 707. Therefore, when in use, the inclined supporting beam 709, the table surface 705, and the sliding frame form a right-angled triangle substantially, and the supporting beam 709, the active posts 7061 and 7062 and the floor form a right-angled triangle substantially such that the foldable chair has a stable supporting structure and is not easy to be deformed when it is in fully unfolded state as shown in FIG. 8.

In addition, in order to further improve the stability of the supporting structure of the chair in this embodiment, a first transverse lever 7081 and a second transverse lever 7082 may be connected between the two active posts 7061, 7062 and the sliding frame 104. The first transverse lever 7081 and the second transverse lever 7082 can be rotated respectively around their joints to the sliding frame 104, and around their joints to the sliding frame 104. When the foldable chair is fully unfolded as shown in FIGS. 7, 8, a triangle is formed by the active posts 7061, 7062 and the inclined lever 707, it further secures the active posts 7061, 7062 and improves the stability of the foldable chair in unfolded state.

In addition, the joints around which parts can be rotated may be realized by hinges or other possible manners in the art.

During the folding of the table as shown in FIGS. 9 and 10, the inclined levers 707, is rotated inwards along with the table surface 705. When the sliding frame 704 is raised to a certain height level along the first and second guide rail mechanisms and the table surface 705 is hung on the side of the sliding frame 704, the inclined lever 707 is rotated to upstanding state, and the volume is minimized after folding.

During the folding of the chair, one end of the first transverse lever 7081 and the second transverse lever 7082 is raised along with the sliding table surface 705, and the table surface 705 is thus rotated under the driving of said one end, whereby the whole folding operation is smoother. Similarly, during the unfolding of the table, the transverse levers 7081, 7082 links the movements of the sliding frame 704 and the table surface 705, which facilitates the unfolding of the chair. In conclusion, the first transverse lever 7081 and the second transverse lever 7082 improve the stability of the foldable frame when in fully unfolded state, and also improves the smoothness of folding operation of the foldable frame.

In this embodiment, the first fixing post 702, the second fixing post 703 may be upright as shown in FIGS. 4, 5, 6, and 7.

Embodiment 4

Figure 11:
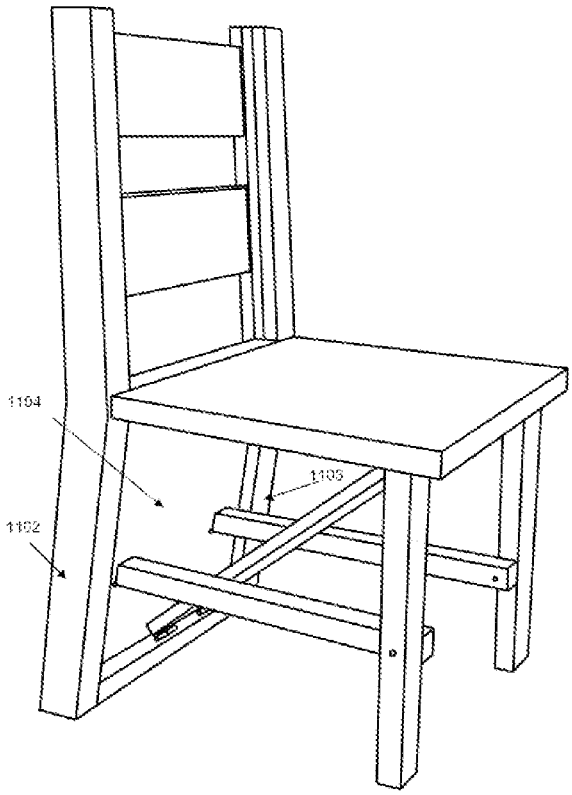
FIG. 11 is a second kind of foldable chair with sliding foldable frame according to the embodiment 4, in fully unfolded state.
Figure 12:
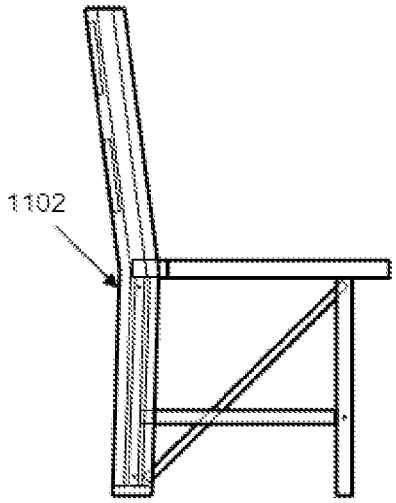
FIG. 12 is a schematic side view showing the foldable chair of FIG. 11 in fully unfolded state.
Figure 13:
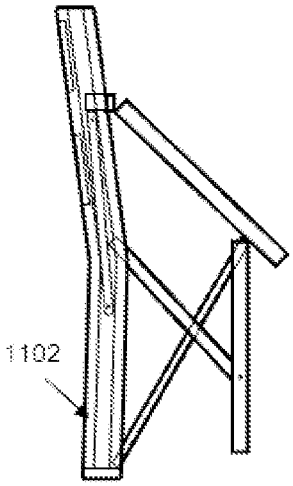
FIG. 13 is a schematic side view showing the foldable chair of FIG. 11 in half folded state.
Figure 14:
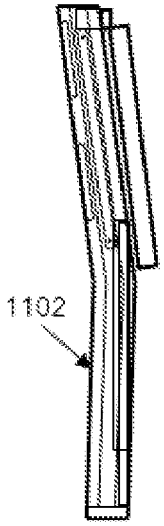
FIG. 14 is a schematic side view showing the foldable chair of FIG. 11 in fully folded state.

FIG. 11 is a second kind of foldable chair with sliding foldable frame according to the embodiment 4, in fully unfolded state; FIG. 12 is a schematic side view showing the foldable chair of FIG. 11 in fully unfolded state; FIG. 13 is a schematic side view showing the foldable chair of FIG. 11 in half folded state; FIG. 14 is a schematic side view showing the foldable chair of FIG. 11 in fully folded state.

Referring to FIGS. 11, 12, 13 and 14, this embodiment is different from the embodiment 4 in that:

Firstly, in the embodiment 3, the first guide rail and the second guide rail in the first fixing post 702 and the second fixing post 703 are upright as shown in the embodiment 2, while in this embodiment, the first fixing post 1102 and the second fixing post 1103 are bended outwards at the upper portion and the lower portion.

In addition to the advantages of the foldable chair of the embodiment 3, it is more comfortable when sitting on the chair of this embodiment, because the first fixing post 1102 and the second fixing post 1103 are slightly bended for use as the back rest of the chair.

Secondly, the sliding frame 1104 consists of the same plate as the embodiment 1.

Embodiment 5

Figure 15:
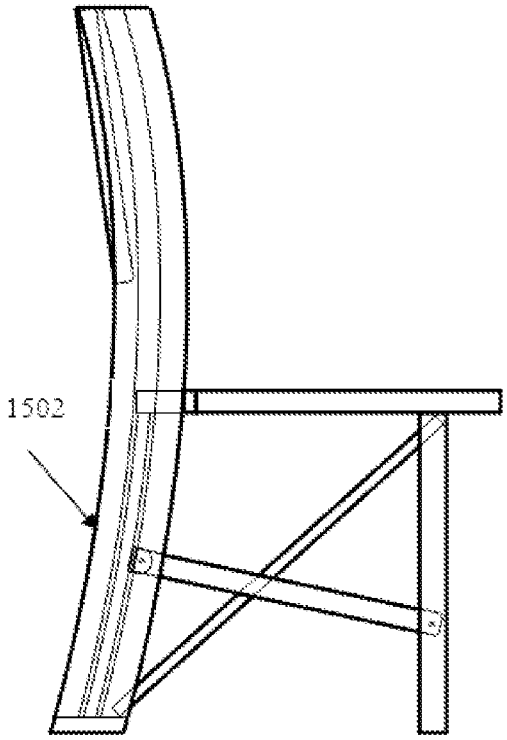
FIG. 15 is a third kind of foldable chair with sliding foldable frame according to the embodiment 5, in fully unfolded state.
Figure 16:
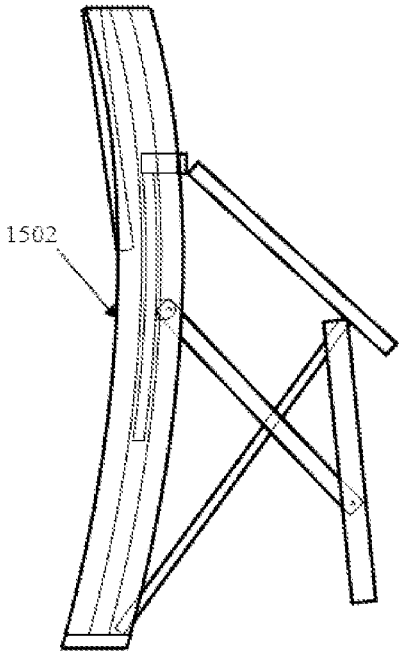
FIG. 16 is a schematic side view showing the foldable chair of FIG. 15 in fully unfolded state.
Figure 17:
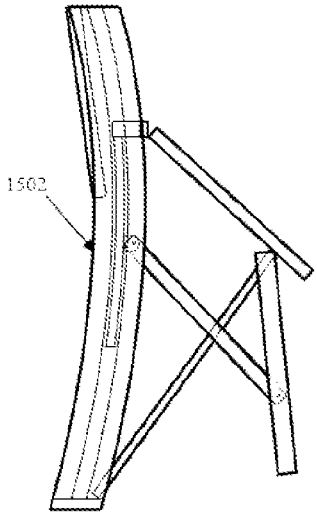
FIG. 17 is a schematic side view showing the foldable chair of FIG. 15 in half folded state.

FIG. 15 is a third kind of foldable chair with sliding foldable frame, in fully unfolded state; FIG. 16 is a schematic side view showing the foldable chair of FIG. 15 in fully unfolded state; FIG. 17 is a schematic side view showing the foldable chair of FIG. 15 in half folded state.

Referring to FIGS. 15, 16 and 17, the foldable chair in this embodiment is different from the embodiments 3 and 4 in that:

The first fixing post 1502 and the second fixing post are close to the chair seat at the middle while they are bended outwards at both ends to become arc-shaped, and the first guide rail and the second guide rail in the first fixing post 1502 and the second fixing post are also arc-shaped.

In addition to the advantages of the foldable chair of the embodiment 2, it is more comfortable when sitting on the chair of this embodiment, because the first fixing post 1502 and the second fixing post are arc-shaped and adapted to the human body.

Embodiment 6

Figure 18:
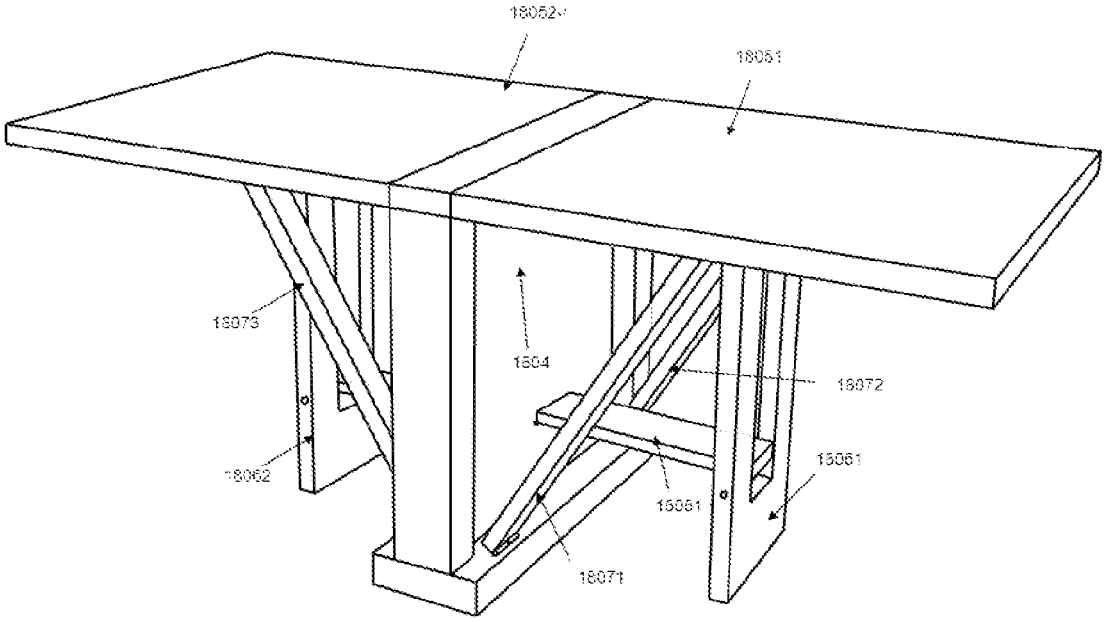
FIG. 18 is a schematic structural view showing a double-wing foldable table that can be slid up and down according to the embodiment 6, in fully unfolded state, seen from one direction.
Figure 19:
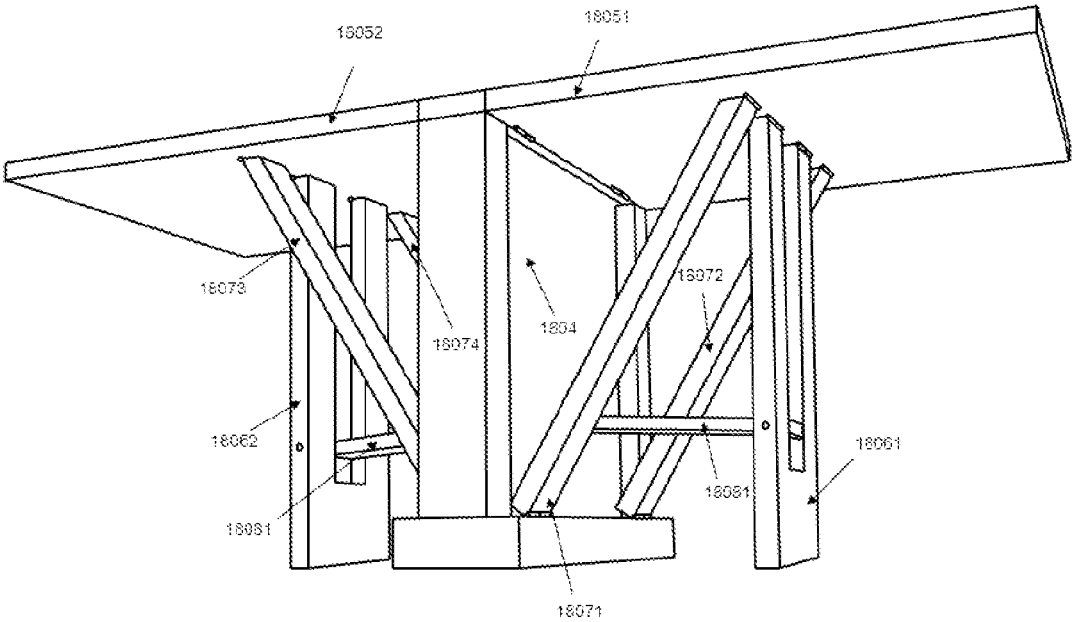
FIG. 19 is a schematic structural view showing the double-wing foldable table of FIG. 18, in fully unfolded state, seen from another direction.
Figure 20:
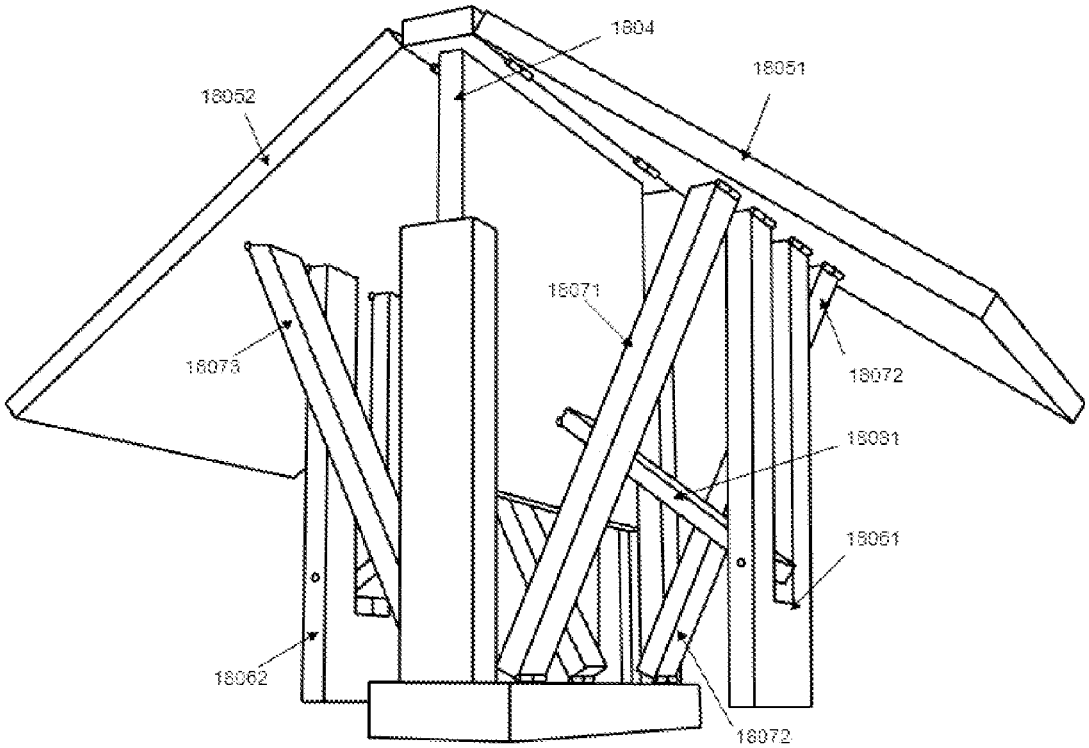
FIG. 20 is a schematic structural view showing the double-wing foldable table of FIG. 18 in half folded state.
Figure 21:
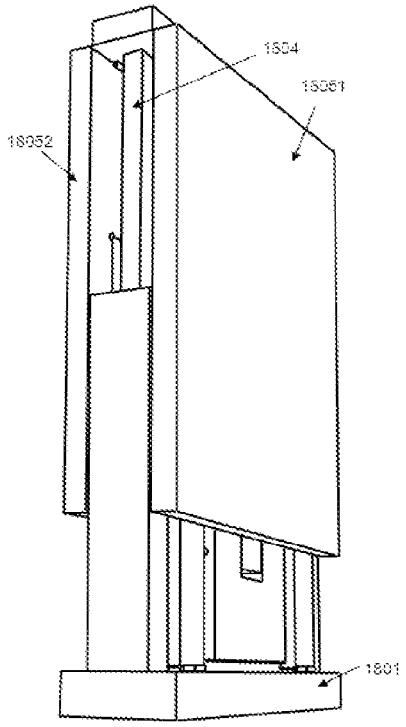
FIG. 21 is a schematic structural view showing the double-wing foldable table of FIG. 18 in fully folded state.

FIG. 18 is a schematic structural view showing a double-wing foldable table that can be slid up and down according to the embodiment 6, in fully unfolded state, seen from one direction; FIG. 19 is a schematic structural view showing the double-wing foldable table of FIG. 18, in fully unfolded state, seen from another direction; FIG. 20 is a schematic structural view showing the double-wing foldable table of FIG. 18 in half folded state; FIG. 21 is a schematic structural view showing the double-wing foldable table of FIG. 18 in fully folded state.

Referring to FIGS. 18, 19, 20 and 21, the foldable table of this embodiment is different from the embodiment 2 in that:

A first table surface 18051 and a second table surface 18052 are respectively provided on both sides of the sliding frame 1804, and the back of the first table surface 18051 is connected with a first active post 18061, a first inclined lever 18071, a second inclined lever 18072 and a first transverse lever 18081. The connection structure between the first table surface 18051 and the first active post 18061, the first inclined lever 18071, the second inclined lever 18072 and the first transverse lever 18081 is identical to that of the embodiment 2.

Similar to the structure of the first table surface 18051, the back of the second table surface 18052 is connected with a second active post 18062, a third inclined lever 18073, a fourth inclined lever 18074 and a second transverse lever 18082. The connection structure between the second table surface 18052 and the second active post 18062, the third inclined lever 18073, the fourth inclined lever 18074 and the second transverse lever 18082 is identical to that of the embodiment 2.

In addition to the advantages of the embodiment 2, the length of the foldable table is two times as large as that of the embodiment 2 since the folding structure is provided on each side of the sliding frame 1804. However, the volume after folding is only slightly bigger, which saves the storage space greatly and reduces the transportation cost.

Embodiment 7

Figure 22:
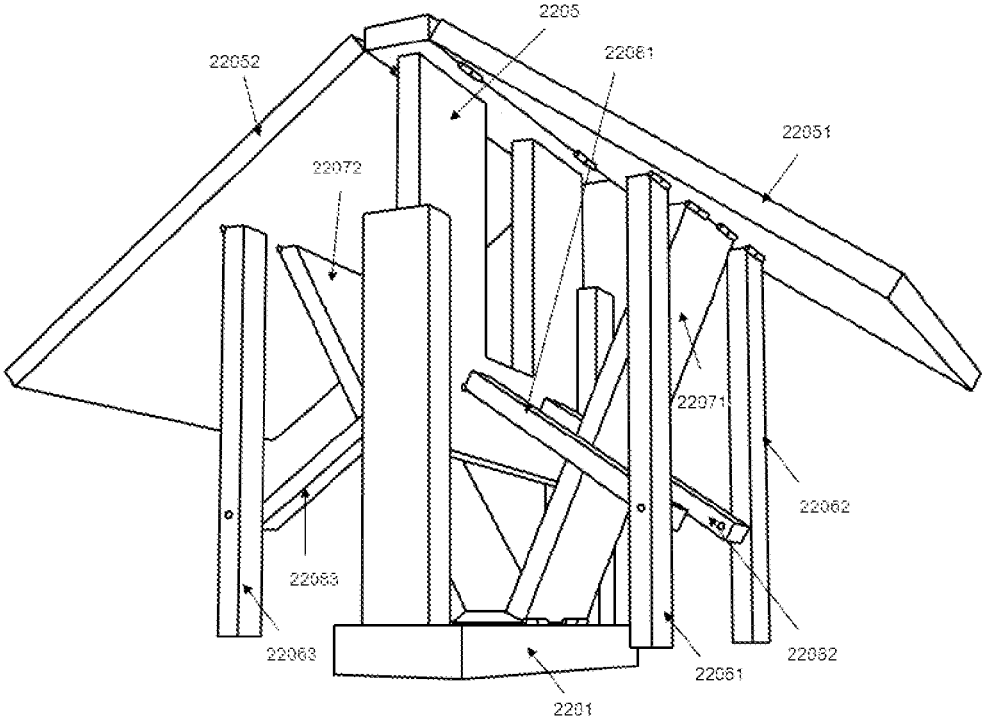
FIG. 22 is a schematic structural view showing a second double-wing foldable table that can be slid up and down according to the embodiment 7, in half unfolded state.

FIG. 22 is a schematic structural view showing a second double-wing foldable table that can be slid up and down according, in half unfolded state.

Referring to FIG. 22, the foldable table of this embodiment is different from the embodiment 6 in that:

1. The sliding frame 2204 is empty in the middle, which saves the materials.

2. The back of the first table surface 22051 is hinged with a first active post 22071 and a second active post 22072, and connected to a first inclined lever 22071. The other end of the first inclined lever 22071 is hinged to the base 2201. The inclined 22071 is located between the first active post 22071 and the second active post 22072. The first active post 22071 and the second active post 22072 are hinged with a first transverse lever 22081 and a second transverse lever 22082 respectively. The other end of the first transverse lever 22081 and the second transverse lever 22082 are hinged to the sliding frame 2204.

Similar to the structure of the first table surface 22051, the back of the second table surface 22052 is hinged to the third active post 22063 and the fourth active post 22064. The back of the second table surface 22052 is connected with the second inclined lever, and the other end of the second inclined lever is hinged to the base 2201. The second inclined lever is located between the third active post 22063 and the fourth active post 22064. The third active post 22063 and the fourth active post 22064 are respectively hinged to the third transverse lever 22083 and the fourth transverse lever 22084. The other end of the third transverse lever 22083 and the fourth transverse lever 22084 is hinged to the sliding frame 2204.

Comparing with the embodiment 6 in which the back of each table surface has one active post supporting structure, two active post supporting structures are provided to increase the stability of the foldable table without increase the volume of the foldable table after folding.

Embodiment 8

Figure 23:
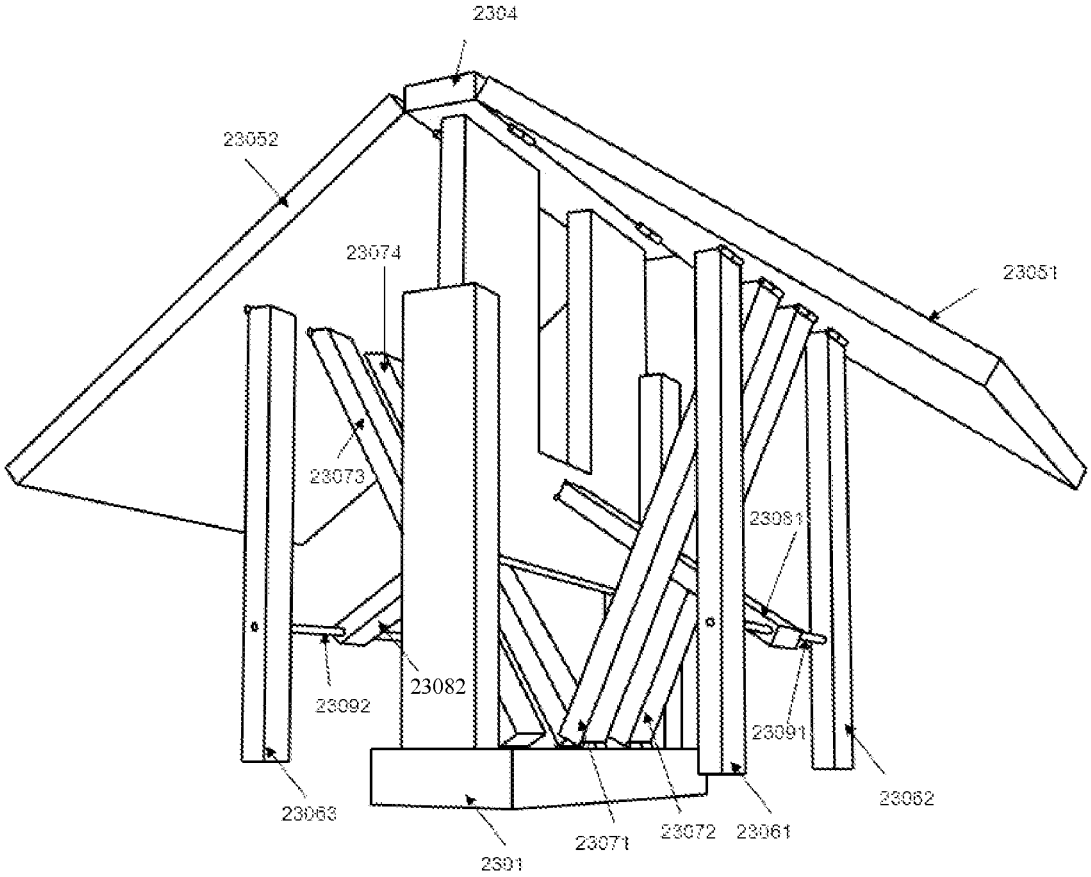
FIG. 23 is a schematic structural view showing a third double-wing foldable table that can be slid up and down according to the embodiment 8, in half unfolded state.

FIG. 23 is a schematic structural view showing a third double-wing foldable table that can be slid up and down, in half unfolded state.

Referring to FIG. 23, the foldable table of this embodiment is different from the embodiment 7 in that:

1. The first transverse bar 23091 is connected between the first active post 23061 and the second active post 23062 on the back of the first table surface 23051. The first transverse bar 23091 passes through the first transverse lever 23081, and the other end of the first transverse lever 23081 is hinged to the sliding frame 2304.

Similarly, a second transverse bar 23092 is connected between the third active post 23063 and the fourth active post 23064. The second transverse bar 23092 passes through the second transverse lever 23082, and the other end of the second transverse lever 23082 is hinged to the sliding frame 2304.

2. The back of the first table surface 23051 is connected with a first inclined lever 23071 and a second inclined lever 23072. The other end of the first inclined lever 23071 and the second inclined lever 23072 is hinged to the base. The first transverse lever 23081 is located between the first inclined lever 23071 and the second inclined lever 23072.

Similarly, a second transverse bar 23052 is connected between the third active post 23073 and the fourth active post 23074. The other ends of the third inclined lever 23073 and the fourth inclined lever 23074 are hinged to the base. The second transverse lever 23082 is located between the third inclined lever 23073 and the fourth inclined lever 23074.

The advantages of this embodiment is substantially identical to the embodiment 7.

Although the disclosure has been herein shown and described in what is conceived to be the most practical and preferred embodiment, it is recognized that departures can be made within the scope of the invention, which is not to be limited to the details described herein but is to be accorded the full scope of ay appended claims so as to embrace any and all equivalent devices and apparatus.

What is claimed is:

1. A foldable frame, comprising:

a base;

a first fixing post;

a second fixing post;

a sliding frame;

a table surface;

wherein the first fixing post and the second fixing post are respectively fixed on both ends of the base;

a first guide rail and a second guide rail are provided on the first fixing post and the second fixing post respectively and opposite to each other, the sliding frame is provided between the first guide rail and the second guide rail and adapted to slide up and down along the first guide rail and the second guide rail;

the table surface is horizontally connected to a side of the sliding frame and adapted to be rotated in a vertical plane around a joint between the table surface and the sliding frame, the table surface is adapted to be horizontally positioned;

inclined levers are hinged to the table surface at one end, and the other end of the inclined levers is hinged to the base, wherein an active post is further hinged to the back surface of the table surface, the active post is further hinged to a transverse lever at one end, and the other end of the transverse lever is hinged to the sliding frame; the table surface is horizontal when the bottom of the active post and the bottom of the base are horizontal.

2. The foldable frame of claim 1, wherein the transverse lever is connected to the active post by a first joint, and the transverse lever is connected to the incline levers by a second joint, wherein the first joint is lower than the second joint in horizontal level when the bottom of the active post is at the same horizontal level as the bottom of the base.

3. The foldable frame of claim 1, wherein the back surface of the table surface is further connected with two active posts, and each active post is hinged to the transverse lever.

4. The foldable frame of claim 1, wherein the back surface of the table surface is further hinged with two active posts, each active post is hinged to one end of the transverse lever, the other end of the transverse lever is hinged to the sliding frame; the table surface is horizontal when the bottom of each active post is at the same horizontal level as the bottom of the base; the inclined levers are hinged to the back surface of the table surface and located between the two active posts, and the other end of the inclined levers are is hinged to the base.

5. The foldable frame of claim 1, wherein a vertical gap is provided in the active post while the transverse lever is hinged to the vertical gap, the other end of the transverse lever is hinged to the sliding frame; the table surface is horizontal when the bottom of the active post is at the same horizontal level as the bottom of the base; two inclined levers are hinged to the back surface of the table surface and located at both sides of the active post, and the other end of the inclined levers is hinged to the base.

6. The foldable frame of claim 1, wherein the first fixing post, the second fixing post, and the first guide rail and the second guide rail in the first fixing post and the second fixing post are all higher than the table surface when the table surface is rotated to be horizontal.

7. The foldable frame of claim 1, wherein the first guide rail and the second guide rail are straight or arched in shape.

8. The foldable frame of claim 1, wherein the sliding frame is made of one piece or made of several pieces.

9. The foldable frame of claim 1, wherein the first fixing post and the second fixing post are bended outwards at the upper portion and the lower portion.

10. A foldable frame, comprising:

a base;

a first fixing post;

a second fixing post;

a sliding frame;

two table surfaces;

the two table surfaces are horizontally connected to a side of the sliding frame and adapted to be respectively rotated in a vertical plane around a joint between each of the two table surfaces and the sliding frame, the table surface is adapted to be horizontally positioned;

the first fixing post and the second fixing post are respectively fixed on both ends of the base;

a first guide rail and a second guide rail are provided on the first fixing post and the second fixing post respectively and opposite to each other, the sliding frame is provided between the first guide rail and the second guide rail and adapted to slide up and down along the first guide rail and the second guide rail;

an active post is further hinged to the back surface of the two table surfaces, the active post is further hinged to a transverse lever at one end, and the other end of the transverse lever is hinged to the sliding frame; the two table surfaces are horizontal when the bottom of the active post and the bottom of the base are horizontal; an inclined lever is hinged to the back surface of the two table surfaces, and the other end of the inclined lever is hinged to the base.

11. A foldable frame, comprising:

a base;

a first fixing post;

a second fixing post;

a sliding frame;

a table surface;

wherein the first fixing post and the second fixing post are respectively fixed on both ends of the base;

a first guide rail and a second guide rail are provided on the first fixing post and the second fixing post respectively and opposite to each other, the sliding frame is provided between the first guide rail and the second guide rail and adapted to slide up and down along the first guide rail and the second guide rail;

the table surface is horizontally connected to a side of the sliding frame and adapted to be rotated around a joint between the table surface and the sliding frame, the table surface is adapted to be horizontally positioned;

an active post is further hinged to the back surface of the table surface, the table surface is horizontal when the bottom of the active post and the bottom of the base are horizontal;

the first fixing post and the second fixing post are not vertical to the table surface.

* * * * *